US010840050B2

(12) United States Patent
Lu et al.

(10) Patent No.: US 10,840,050 B2
(45) Date of Patent: Nov. 17, 2020

(54) FIELD EMISSION CATHODE ELECTRON SOURCE AND ARRAY THEREOF

(71) Applicant: THE INSTITUTE OF MICROELECTRONICS OF CHINESE ACADEMY OF SCIENCES, Beijing (CN)

(72) Inventors: Weier Lu, Beijing (CN); Yang Xia, Beijing (CN)

(73) Assignee: THE INSTITUTE OF MICROELECTRONICS OF CHINESE ACADEMY OF SCIENCES, Beijing (CN)

( * ) Notice: Subject to any disclaimer, the term of this patent is extended or adjusted under 35 U.S.C. 154(b) by 0 days.

(21) Appl. No.: 16/648,665

(22) PCT Filed: Feb. 25, 2019

(86) PCT No.: PCT/CN2019/076083

§ 371 (c)(1),
(2) Date: Mar. 19, 2020

(87) PCT Pub. No.: WO2020/042549

PCT Pub. Date: Mar. 5, 2020

(65) Prior Publication Data

US 2020/0219693 A1 Jul. 9, 2020

(30) Foreign Application Priority Data

Aug. 30, 2018 (CN) ..... 2018 1 1006185

(51) Int. Cl.
*H01J 1/304* (2006.01)

(52) U.S. Cl.
CPC ..... *H01J 1/3044* (2013.01)

(58) Field of Classification Search
CPC ..... H01J 1/3044; H01J 1/304; H01J 1/3042; H01J 1/02; H01J 1/30; H01J 1/3046; H01J 1/3048; H01J 13/20; H01J 21/10
See application file for complete search history.

(56) References Cited

U.S. PATENT DOCUMENTS 4,827,177 A * 5/1989 Lee ..... H01J 21/105 313/306
4,904,895 A * 2/1990 Tsukamoto ..... B82Y 10/00 313/336

(Continued)

FOREIGN PATENT DOCUMENTS

CN 101110306 A 1/2008
CN 102064071 A 5/2011

OTHER PUBLICATIONS

International search report of PCT/CN2019/076083.

*Primary Examiner* — Joseph L Williams
*Assistant Examiner* — Jose M Diaz

(57) ABSTRACT

A field emission cathode electron source and an array thereof provided by embodiments of the present disclosure include a substrate, and a cathode, a cathode tip and a gate disposed on the same side of the substrate. The cathode, the cathode tip and the gate are disposed on an upper surface of the substrate, and the cathode tip is connected to the cathode, and the gate is located on a side of the cathode tip away from the cathode and an electron emission end of the cathode tip is directed toward a side of the substrate close to the gate. The cathode tips are arranged on the substrate in parallel with the substrate. Compared with the three dimensional stacked structure in the prior art, the present disclosure has a higher stability and reliability and is suitable for a large-scale integration.

7 Claims, 3 Drawing Sheets

(56) References Cited

U.S. PATENT DOCUMENTS

| | | | | | |
|---|---|---|---|---|---|
| 4,956,574 | A * | 9/1990 | Kane | H01J 1/3042 | 313/306 |
| 5,148,079 | A * | 9/1992 | Kado | H01J 1/3042 | 313/309 |
| 5,173,635 | A * | 12/1992 | Kane | H01J 1/3042 | 313/306 |
| 5,214,346 | A * | 5/1993 | Komatsu | H01J 3/022 | 313/309 |
| 5,386,172 | A * | 1/1995 | Komatsu | H01J 1/3042 | 313/309 |
| 5,463,277 | A * | 10/1995 | Kimura | H01J 21/105 | 315/169.1 |
| 5,502,314 | A * | 3/1996 | Hori | H01J 1/3042 | 257/10 |
| 5,580,467 | A * | 12/1996 | Kim | H01J 9/025 | 216/11 |
| 5,614,795 | A * | 3/1997 | Kim | H01J 1/3042 | 313/336 |
| 5,786,658 | A * | 7/1998 | Tsukamoto | B82Y 10/00 | 313/309 |
| 5,859,493 | A * | 1/1999 | Kim | H01J 3/022 | 313/309 |
| 7,583,015 | B2 * | 9/2009 | Nukanobu | H01J 1/316 | 313/309 |
| 9,269,522 | B2 * | 2/2016 | Lee | H01J 1/304 | |
| 2008/0030117 | A1 * | 2/2008 | Chen | H01J 21/02 | 313/311 |
| 2012/0092103 | A1 * | 4/2012 | Roberts | H01F 7/0284 | 335/295 |

* cited by examiner

FIELD EMISSION CATHODE ELECTRON SOURCE AND ARRAY THEREOF

TECHNICAL FIELD

The disclosure relates to the technical field of electron emission, in particular to a field emission cathode electron source and an array thereof.

BACKGROUND OF THE INVENTION

An electron source is considered to be the core of a vacuum electronic device, providing free electron beams necessary for its work. The field emission electron source suppresses the surface barrier of a field emitting material by applying a strong electric field outside the field emitting, material, reducing the height of the barrier and narrowing the width of the barrier, so that a considerable number of electrons travel from the inside of the field emitting material to the outside thereof through the tunneling effect and generate a directional movement under the action of the external electric field, thereby forming a certain emission current density.

A basic structure of a typical, field emission electron source may usually include a cathode, a gate, and an anode. Microfield emission cathode array is a kind of densely integrated electron source in a certain area through modern fabrication methods. Since the occurrence of the microfield emission array, a variety of structures have been developed. Among them a Spindt cathode, also known as a thin-film metal field emission cathode, is the earliest field emission cathode fabricated by modern micromachining methods, including an array type cathode consisting of a micro emission pointed cone, an insulation layer and a gate in structure. Because the radius of curvature of the micro emission pointed cone is small and the distance between the micro pointed cone and the gate is also very close, only a small bias voltage between the two is sufficient to induce electron emission on the surface of the pointed cone. The field emission cathode array can achieve high-density integration of a large number of arrays of emission pointed cones based on micro-nano fabrication technology, so high total emission current and current density can be obtained.

However, due to the three-dimensional structure of the field emission pointed cone array, the parameters such as the height and diameter of the pointed cones deposited during fabrication are different, and the uniformity of the obtained array is poor, which is prone to cause local over-emission, and the electrons emitted perpendicularly to an upper surface of the substrate are likely to cause space discharge and induce electric arcs, thus easily causing damage to the entire device and resulting in poor reliability.

SUMMARY OF THE INVENTION

An object of the present disclosure is to provide a field emission cathode electron source and an array thereof, wherein a cathode, a cathode tip and a gate are disposed in the same plane, which avoids the problem in the prior art that the fabrication of field emission pointed cones is difficult to control and improves the uniformity of the array.

In one aspect, a field emission cathode electron source is provided which may comprise: a substrate, and a cathode, a cathode tip and a gate disposed on the same side of the substrate. The cathode, the cathode tip and the gate are all disposed on an upper surface of the substrate. The cathode tip is connected to the cathode, and the gate is located on a side of the cathode tip away from the cathode, and an electron emission end of the cathode tip is directed toward a side of the substrate close to the gate.

In some embodiments, there may be two gates, and the two gates may be respectively arranged on two sides of the cathode tip.

In some embodiments, the cathode tip may have a triangular shape.

In some embodiments, the field emission cathode electron source may further comprise an insulating layer disposed on the upper surface of the substrate, and the cathode, the cathode tip and the gate are all disposed on the insulating layer.

In some embodiments the substrate may be made of silicon material and the insulating layer may be made of silicon oxide.

In some embodiments, the insulating layer may have a thickness greater than or equal to 290 nm.

In some embodiments, the field emission cathode electron source may be fabricated by a planar process.

In another aspect, a field emission cathode electron source array is provided which may comprise a plurality of field emission cathode electron sources mentioned above, and the plurality of field emission cathode electron sources are connected side by side in a row; and a plurality of the cathode tips face, toward the same direction.

In some embodiments, in the same row, the cathode of each of the field emission cathode electron sources may be connected or not connected with the cathode of an adjacent field emission cathode electron source.

In some embodiments, the field emission cathode electron source array may comprise a plurality of electron source rows stacked with one another, and each of the electron source rows may be composed of a plurality of field emission cathode electron sources connected side by side in a row.

With the field emission cathode electron source and the array thereof according to embodiments of the present disclosure described above, in compared with the electron sources in the prior art, a cathode, a cathode tip and a gate are disposed on the same side of the substrate, and the cathode, the cathode tip, and the gate are all disposed on an upper surface of the substrate; and the electron emission end of the cathode tip is directed toward the side of the substrate close to the gate; thus an electron emission direction is changed from being perpendicular to the upper surface of the substrate into being parallel to the upper surface of the substrate, avoiding three-dimensional stacked structural design of the cathode tips (or electron emission ends), and it is easier to control parameters such as length and width during production and fabrication. Meanwhile, when the cathode tip is fabricated, in compared with the field emission pointed cone in the prior art, consideration of production parameters, such as height and diameter of a field emission pointed cone, which are difficult to control, can be avoided during fabrication, and the obtained field emission cathode electron source has higher stability. Further, the array composed of the field emission cathode electron sources has an optimized cathode tip structure; besides that, because the substrate can isolate the respective cathode tips, the occurrence of electric arcs can be further avoided and the array as a whole has better uniformity and the reliability of associated devices using the field emission cathode electron source and the array thereof can be improved.

In order to make the objects, the features, and the advantages of the present disclosure more obvious, preferred embodiments will be described, below in detail with reference to the accompanying drawings.

BRIEF DESCRIPTION OF THE DRAWINGS

In order to explain the technical solution of the embodiments of the present disclosure more clearly, the drawings used in the embodiments will be briefly introduced below. It should be understood that the following drawings only show some embodiments of the present disclosure, and therefore should not be regarded as a limitation on the scope. For those of ordinary skill in the art, other related drawings can be obtained based on these drawings without creative work.

LIST OF REFERENCE NUMERALS

Figure 1:
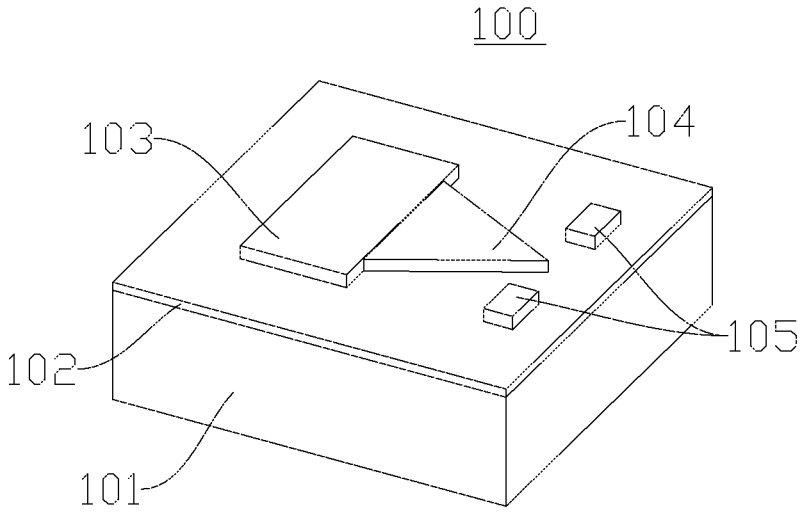
FIG. 1 is a schematic structural diagram of a field emission cathode electron source according to a first embodiment of the present disclosure.

100—field emission cathode electron source; 101—substrate; 102—insulating layer; 103—cathode; 104—cathode tip; 105—gate; 106—emission direction; 200—field emission cathode electron source array; 300—field emission cathode electron source array

DETAILED DESCRIPTION OF THE INVENTION

In order to make the objectives, the solutions, and the advantages of the embodiments of the present disclosure clearer, the technical solutions in the embodiments of the present disclosure will be clearly and completely described with reference to the accompanying drawings. Obviously, the described embodiments are simply part of embodiments of the present disclosure, but not all the embodiments. The components of embodiments of the disclosure, described and illustrated in the figures herein, can be arranged and designed in a variety of different configurations.

Therefore, the following detailed description of the embodiments of the present disclosure provided in the drawings is not intended to limit the scope of the claimed invention, but merely represents selected embodiments of the present disclosure. Based on the embodiments of the present disclosure, all other embodiments obtained by a person of ordinary skill in the art without creative efforts shall fall within the protection scope of the present invention.

It should be noted that similar reference numerals and characters indicate similar items in the following drawings, so once an item is defined in one drawing, it need not be further defined and explained in subsequent drawings.

In the description of the present disclosure, it should also be noted that the terms "dispose", "install", and "connect" and the like as well as, their derivatives should be understood in a broad sense unless otherwise specified and limited. For example, it can be a fixed connection, a detachable connection or an integral connection; it can be mechanical or electrical connection; it can be directly connected, or it can be indirectly connected through an intermediate medium, or it can be an internal communication of two elements. For those of ordinary skill in the art, the specific meanings of the above terms in the present disclosure can be understood according to specific situations.

First Embodiment

Referring to FIG. 1, according to this embodiment, a field emission cathode electron source 100 is provided, including a substrate 101, and a cathode 103, a cathode tip 104 and a gate 105 disposed on the same side of the substrate 101. The cathode 103, the cathode tip 104 and the gate 105 are disposed on an upper surface of the substrate 101 (the upper surface herein should be understood as any one of the surfaces of the substrate 101, and does not change, when its position relative to the horizontal plane is changed artificially; the surrounding surfaces of the upper surface are referred to as side surfaces of the substrate 101 in the present disclosure).

The substrate 101 is used to support the arrangement of the cathode 103, the cathode tip 104, the gate 105, and the like.

In this embodiment, the substrate 101 may have a square shape (or other shapes such as a circular shape, a triangular shape). The substrate 101 may be made of an insulating material or any other material. Specifically, it may be made of silicon oxide, aluminum oxide tantalum oxide, hafnium oxide, zinc oxide, zirconium oxide, silicon nitride, diamond, or the like.

Generally, in order to ensure insulation effect, the surface of the substrate 101 (specifically, the side where the cathode 103, the cathode tip 104, and the gate 105 are provided) is covered with an insulating layer 102. In this situation, the cathode 103, the cathode tip 104 and the gate 105 are all disposed on the insulating layer 102. A specific arrangement can be covering an insulating layer 102 of silicon oxide on the surface of a silicon substrate, and the thickness of the insulating layer 102 can be adjusted according to the voltage of the operating environment so as to prevent breakdown. In some embodiments, the thickness of the insulating layer 102 may be 300 nm, or may be greater than 300 nm, or may be less than 300 nm. For example, it may be 290 nm or more than 290 nm.

The cathode 103 may be an electrode to be applied a voltage and is configured to be connected with the cathode tip 104; the cathode tip 104 is configured to emit electrons.

Figure 2:
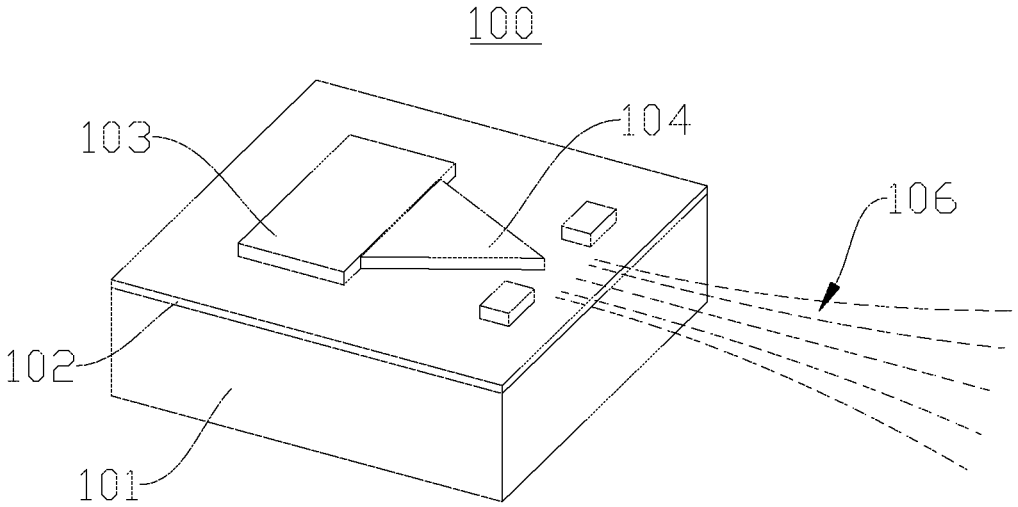
FIG. 2 is a schematic structural diagram showing an electron emission state of the field emission cathode electron source according to the first embodiment of the present disclosure.

The cathode tip 104 may be connected to the cathode 103. The cathode 103 may have a square block (rectangular, square) shape, a trapezoidal shape, etc. The cathode tip 104 is connected to one side of the cathode 103. In some embodiments, the cathode tip 104 has a triangular shape, whose bottom edge is connected to the cathode 103 to ensure a larger connection face (point), and an end opposite to the bottom edge is an electron emission end. The electron emission end of the cathode tip 104 (which is of a conductive microtip structure) is directed toward the side of the substrate 101 close to the gate 105 to ensure that electrons can be accurately emitted from the electron emission end of the cathode tip 104 and a fabrication by a planer process can be performed. FIG. 2 shows an emission direction 106.

In order to further control the emission direction of the electrons, two gates 105 may be provided at the electron emission end of the cathode tip 104. In some embodiments, the gates 105 are located on a side of the cathode tip 104 away from the cathode 103, and the two gates 105 are respectively arranged on two sides of the cathode tip 104. In the present disclosure, the cathode 103 and the gate 105 cooperates to apply a voltage across the electron source so that electrons are emitted from the cathode tip 104 with a low potential, and are accurately drawn, out from the side through a gate hole with a high potential.

In the present disclosure, to achieve an required structure of the field emission cathode electron source 100, a preferred embodiment is to fabricate the device by a planar process. At the same time, with the form that the substrate 101 made of silicon material is covered with silicon oxide, it can effectively shield diffusion of most important impurities, ensuring a more accurate collective control of the cathode 103, cathode tip 104, gate 105 and the like during fabrication (such as photolithography). At the same time, the covering silicon oxide film can passivate the surface of the device, so that the weakness of being easily affected by the surrounding environment can be suppressed to improve the stability of the device.

In the present disclosure, the materials that can be used for the cathode 103 and the gate 105 can be one or more of the following, such as: metal, graphene, carbon nanotube, and semiconductor. The metal material may be tungsten, molybdenum, palladium, titanium, gold, platinum, copper, rhodium, aluminum, etc.; the semiconductors may be such as silicon, germanium; the graphene may be a monolayer graphene, a multi-layer graphene, a single crystal graphene, or a polycrystalline graphene; the carbon nanotube can be single-walled, multi-walled, a single tube, multiple tubes, or a carbon nanotube film. In this embodiment, the material of the cathode 103 is preferably metal tungsten, and the gate is made of a metal of gold.

Second Embodiment

Figure 3:
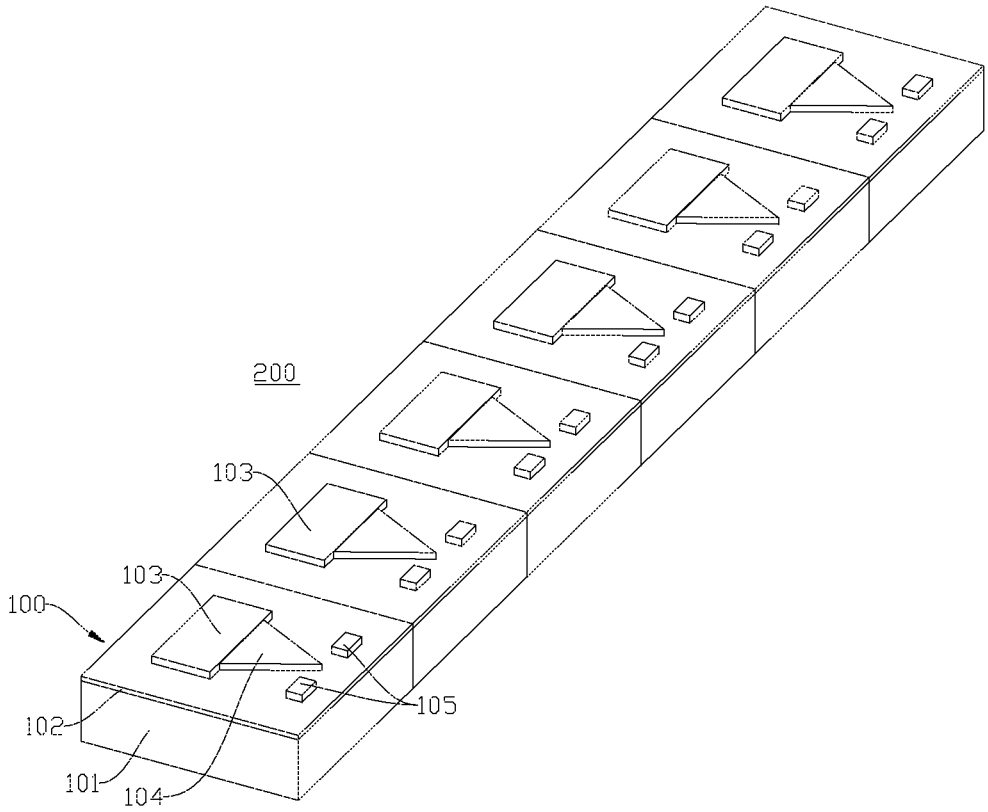
FIG. 3 is a schematic diagram of a first structure of a field emission cathode electron source array according to a second embodiment of the present disclosure.

Referring to FIG. 3, the present disclosure further provides a field emission cathode electron source array 200. Different from the first embodiment, the array 200 is composed of a plurality of field emission cathode electron sources 100.

The plurality of the field emission cathode electron sources 100 are connected side by side in a row, and the cathode 103 of each of the field emission cathode electron sources 100 is connected to the cathode 103 of an adjacent field emission cathode electron source 100. The plurality of the cathode tips 104 face toward the same direction. After the plurality of field emission cathode electron sources 100 are connected side by side in a row, the gates 105 are located on the same axis (only indicating the positional relationship, and there may be errors allowed).

Figure 4:
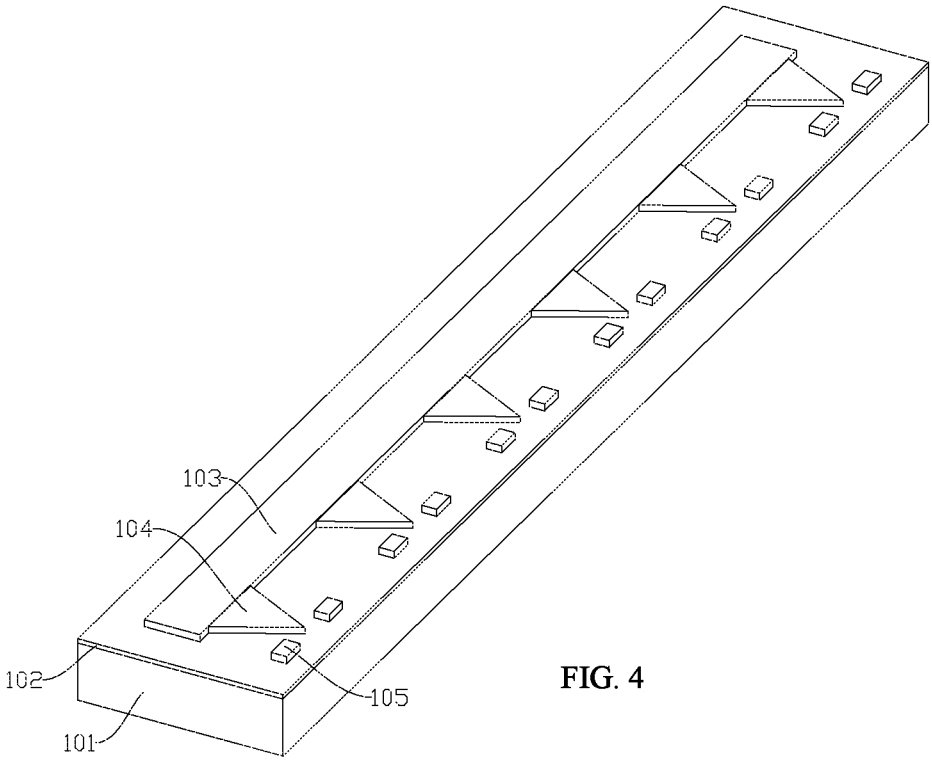
FIG. 4 is a schematic diagram of a second structure of a field emission cathode electron source array according to the second embodiment of the present disclosure.

It should be noted that what is equivalent to this embodiment may be that the substrates 101 of the respective field emission cathode electron sources 100 may be formed integrally as a whole, and the cathodes 103 provided on the substrates 101 may also be integrally formed and electrically connected with one another as a whole, as shown in FIG. 4 (as shown in FIG. 3, the cathodes 103 provided on the substrates 101 are not directly connected to each other).

Figure 5:
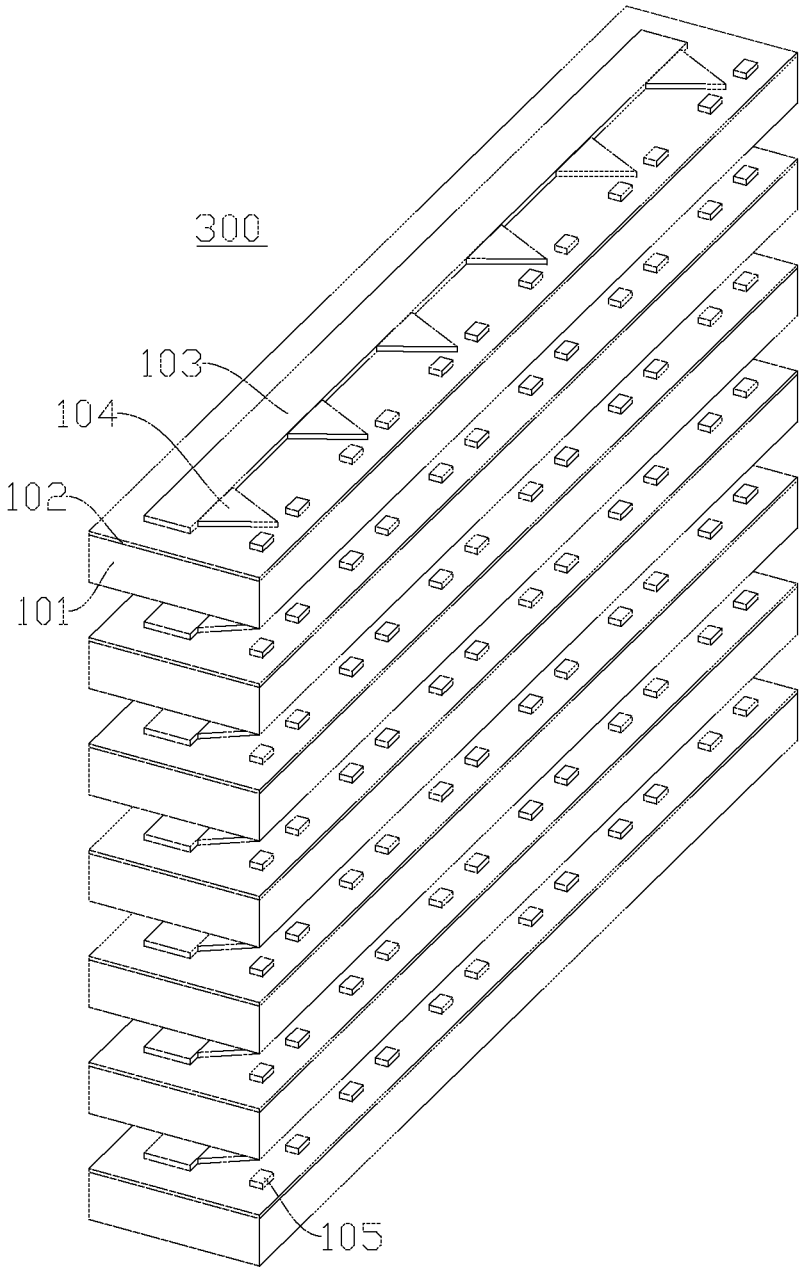
FIG. 5 is a schematic diagram of a third structure of the field emission cathode electron source array according to the second embodiment of the present disclosure.

Referring to FIG. 5, in some embodiments, the above-mentioned field emission cathode electron source array 200 may be stacked to obtain a new field emission cathode electron source array 300. That is, the new field emission cathode electron source array 300 may include a plurality of electron source rows stacked with one another, and each of the electron source rows is composed of a plurality of the field emission cathode electron sources connected side by side in a row (that is, a field emission cathode electron source array 200) so that a large scale integration can be formed to adapt different requirements in use.

In summary, with the field emission cathode electron source and an array thereof according to embodiments of the present disclosure, the cathode, the cathode tip and the gate are disposed on the same side of the substrate, and the cathode, the cathode tip and the gate are all located on the same plane such that when it is fabricated by a planar process, it is easier to control parameters such as length and width during production and fabrication. At the same time, compared with the field emission pointed cones in the prior art, when the cathode tips are fabricated, considerations of production parameters such as the height and diameter or the like of the field emission pointed cones, which are difficult to control, can be avoided during fabrication. When the present invention is implemented, a voltage is applied between the cathode and the gate, and electrons are collected at the cathode tip and guided by the two gates arranged on two sides of the cathode tip so as to be emitted from the cathode tip with a low potential, and drawn out between the gates with a high potential from a side. The field emission cathode electron source with the structure of the present disclosure has higher stability. In addition to the optimized structure of the cathode tips, in the integrated array, the substrates can isolate respective cathode tips, which can further avoid the occurrence of electric arcs, render a high uniformity, and guarantee the safety of relevant devices.

The above descriptions are merely preferred embodiments of the present disclosure and are not intended to limit the present invention. For those skilled in the art, the present disclosure may have various modifications and variations. Any modifications, equivalent replacements, and improvements made within the spirit and principle of the present disclosure shall be included in the protection scope of the present invention.

What is claimed is:

1. A field emission cathode electron source array, comprising: a plurality of field emission cathode electron sources, wherein the field emission cathode electron source comprises a substrate, and a cathode, a cathode tip and a gate disposed on the same side of the substrate, and wherein the cathode, the cathode tip and the gate are all disposed on an upper surface of the substrate; the cathode tip is connected to the cathode, and the gate is located on a side of the cathode tip away from the cathode; and an electron emission end of the cathode tip is directed toward a side of the substrate close to the gate;

and wherein there are two gates, and the two gates are respectively arranged on two sides of the cathode tip;

wherein the plurality of field emission cathode electron sources are connected side by side in a row; and a plurality of the cathode tips face toward the same direction; and in the same row, the cathode of each of the field emission cathode electron sources is not connected with the cathode of an adjacent field emission cathode electron source.

2. The field emission cathode electron source array according to claim 1, comprising a plurality of electron source rows stacked with one another, and each of the electron source rows is composed of a plurality of field emission cathode electron sources connected side by side in a row.

3. The field emission cathode electron source array according to claim 1, wherein the cathode tip has a triangular shape.

4. The field emission cathode electron source array according to claim 1, wherein the field emission cathode electron source further comprises an insulating layer disposed on the upper surface of the substrate, and the cathode, the cathode tip and the gate are all disposed on the insulating layer.

5. The field emission cathode electron source array according to claim 4, wherein the substrate is made of silicon material, and the insulating layer is made of silicon oxide.

6. The field emission cathode electron source array according to claim 4, wherein the insulating layer has a thickness greater than or equal to 290 nm.

7. The field emission cathode electron source array according to claim 1, wherein the field emission cathode electron source is fabricated by a planar process.

* * * * *